United States Patent [19]

Buljan et al.

[11] Patent Number: 4,863,490

[45] Date of Patent: Sep. 5, 1989

[54] TITANIUM DIBORIDE-BASED COMPOSITE ARTICLES WITH ALUMINA DISPERSOIDS, HAVING IMPROVED FRACTURE TOUGHNESS

[75] Inventors: Sergej-Tomislav V. Buljan, Acton; Earl G. Geary, Jr., Lexington, both of Mass.

[73] Assignee: GTE Laboratories Incorporated, Waltham, Mass.

[21] Appl. No.: 158,493

[22] Filed: Feb. 22, 1988

[51] Int. Cl.[4] ..... B24D 3/00

[52] U.S. Cl. ..... 51/293; 51/295; 51/309

[58] Field of Search ..... 51/293, 295, 309

[56] References Cited

U.S. PATENT DOCUMENTS

| | | | |
|---|---|---|---|
| 4,138,456 | 2/1979 | Alliegro | 264/65 |
| 4,341,965 | 7/1982 | Okuo et al. | 310/11 |
| 4,425,141 | 1/1984 | Buljan et al. | 51/309 |
| 4,463,550 | 7/1984 | Hood et al. | 75/229 |
| 4,469,489 | 9/1984 | Sarin et al. | 51/295 |
| 4,507,224 | 3/1985 | Toibana et al. | 252/516 |
| 4,543,343 | 9/1985 | Iyori et al. | 51/309 |
| 4,543,345 | 9/1985 | Wei | 501/95 |
| 4,610,917 | 9/1986 | Yamamura et al. | 428/224 |
| 4,618,529 | 10/1986 | Yamamura et al. | 428/224 |
| 4,673,550 | 6/1987 | Dallaire et al. | 419/12 |
| 4,673,658 | 6/1987 | Gadkaree et al. | 501/89 |
| 4,678,759 | 7/1987 | Kida et al. | 501/92 |
| 4,719,151 | 1/1988 | Chyung et al. | 428/428 |

FOREIGN PATENT DOCUMENTS

| | | |
|---|---|---|
| 52-47803 | 4/1977 | Japan . |
| 60-200863 | 11/1985 | Japan . |
| 86/00528 | 9/1986 | PCT Int'l Appl. . |

OTHER PUBLICATIONS

Tamari et al., *Osaka Kogyo Gijutsu Shikensho Kiho* 33, 129–134 (1962).

Murata et al., *Cer. Bull.* 46, 643–648 (1967).

Lange, *J. Am. Cer. Soc.* 56, 445–450 (1973).

Evans, *J. Am. Cer. Soc.* 65, 127–128 (1982).

Wei et al., *J. Am. Cer. Soc.* 67, 571–574 (1984).

Wills et al., MCIC Report No. MCIC-86-51, "Ceramic-Ceramic Composites", U.S. Department of Defense (1986).

Baldoni et al., *Inst. Phys. Conf. Ser. No. 75: Chapter 5*, 427–438 (1986).

Buljan et al., *Cer. Bull.* 66, 347–352 (1987).

Buljan et al., *Proc. 24th Automotive Technology Dev. Contractors' Coord. Mtg.*, Soc. Automotive Engrs (1987).

Buljan et al., *Mat. Res. Soc. Symp. Proc.* 78, 273–281 (1987).

S. T. Buljan, *Ceramic Technology for Advanced Heat Engines Project Semiannual Progress Report, No. ORNL/TM-10469*, 31–42 (1987).

*Primary Examiner*—Paul Lieberman

*Assistant Examiner*—Willie J. Thompson

*Attorney, Agent, or Firm*—Frances P. Craig

[57] ABSTRACT

Composite articles, cutting tools, and wear parts are prepared by densification of a mixture comprising alumina whiskers, chopped fibers, or particles uniformly distributed in a titanium diboride matrix. Optionally, other dispersoids may also be incorporated. The preferred composite article or cutting tool has a fracture toughness equal to or greater than about 2.5 $MN/m^{3/2}$. Methods of preparation and use are also presented.

23 Claims, No Drawings

TITANIUM DIBORIDE-BASED COMPOSITE ARTICLES WITH ALUMINA DISPERSOIDS, HAVING IMPROVED FRACTURE TOUGHNESS

CROSS-REFERENCE TO RELATED APPLICATIONS

This application is related to commonly owned U.S. application Ser. Nos. 07/158,491 and 07/158,492, filed concurrently herewith, and incorporated herein by reference.

FIELD OF THE INVENTION

This invention relates to fracture and abrasion resistant articles of manufacture. More particularly, it is concerned with fracture and abrasion resistant articles comprising alumina whiskers, fibers, or particles distributed in a matrix of titanium diboride, as well as with methods of preparation and use.

BACKGROUND OF THE INVENTION

The need for materials for cutting tool applications, exhibiting improved toughness, good strength at elevated temperatures, and chemical inertness, and capable of operating at high cutting speeds has generated a widespread interest in ceramic materials as candidates to fulfill these requirements. Conventional ceramic cutting tool materials have failed to find wide application primarily due to their low fracture toughness.

Therefore, many materials have been evaluated to improve ceramic performance, such as silicon nitride-based composites for cutting tool applications. Specific examples of silicon nitride-based composite cutting tools are discussed in U.S. Pat. No. 4,388,085 to Sarin et al. (composite silicon nitride cutting tools containing particles of TiC); U.S. Pat. No. 4,425,141 to Buljan et al. (a composite modified silicon aluminum oxynitride cutting tool containing particulate refractory transition metal carbides, nitrides); U.S. Pat. No. 4,433,979 to Sarin et al. (composite silicon nitride cutting tools containing particulate hard refractory transition metal carbides or nitrides); U.S. Pat. No. 4,449,989 to Sarin et al. (composite silicon nitride cutting tools coated with two or more adherent layers of refractory materials); and U.S. patent application Ser. Nos. 892,642 and 892,634 both filed Aug. 4, 1986 by Baldoni et al. (composite silicon nitride and silicon aluminum oxynitride materials, respectively, containing refractory transition metal carbide, nitride, or carbonitride whiskers).

Many improvements have been made in the toughness, abrasion resistance, high temperature strength and chemical inertness of such materials, but increased demands by the cutting tool industry require cutting tools with new and improved characteristics. Titanium diboride has aroused interest because of its hardness, but has heretofore been considered too brittle for use in such applications as cutting tools.

In applications such as gray cast iron machining, ceramic tool wear has been found to be dominated by abrasion. Even at cutting speeds as high as 5000 sfm, chemical reactions between tool and workpiece are negligible in comparison. It has been found that abrasion resistance for, for example, silicon nitride ceramic cutting tool materials is somewhat more dependent on the fracture toughness than the hardness. It may be seen, therefore, that further improvement in the fracture toughness of ceramic materials could bring about significant increases in both reliability and abrasive wear resistance, providing materials for cutting tools with new and improved characteristics. The present invention provides such new and improved ceramic materials.

The wear-resistant titanium diboride-based composites according to the invention are also useful in wear part and structural applications, for example as seals, dies, parts for automotive engines, nozzles, etc, and in impact resistant applications, for example as ceramic armor, etc.

SUMMARY OF THE INVENTION

A densified, hard, abrasion resistant ceramic-based composite article of improved fracture toughness according to the invention includes about 5–60 volume percent of one or more dispersoids selected from alumina whiskers, chopped alumina fibers, and alumina particles, uniformly distributed in a matrix of titanium diboride.

A process according to the invention for preparing the densified, hard, abrasion resistant ceramic-based composite article of improved fracture toughness involves blending a mixture including about 95–40 volume percent titanium diboride powder and about 5–60 volume percent of one or more first dispersoids, to uniformly disperse the dispersoids in the titanium diboride powder. The dispersoids are selected from alumina whiskers, chopped alumina fibers, and alumina particles. The mixture is consolidated to a density of at least about 98% of theoretical density to form the article.

A method according to the invention for continuous or interrupted machining of steel stock involves milling, turning, or boring the stock with a shaped, densified, hard, abrasion resistant ceramic-based composite cutting tool of improved fracture toughness. The cutting tool includes a densified, hard, abrasion resistant ceramic-based composite article of improved fracture toughness including about 5–60 volume percent of one or more dispersoids, uniformly distributed in a matrix of titanium diboride. The dispersoids are selected from alumina whiskers, chopped alumina fibers, and alumina particles. The machining speed is about 100–1500 sfm, and the feed rate is about 0.005–0.03 in/rev.

DETAILED DESCRIPTION OF THE PREFERRED EMBODIMENTS

For a better understanding of the present invention, together with other and further objects, advantages and capabilities thereof, reference is made to the following disclosure and appended claims.

Fracture toughened and abrasion resistant materials according to the present invention comprise alumina whiskers, chopped alumina fibers, or alumina particles, dispersed in a titanium diboride matrix.

The hard refractory whiskers incorporated into materials in accordance with this invention each comprise a single crystal, while the fibers are polycrystalline. Preferably the fibers or whiskers have an average diameter of about 0.5–5 microns and an average length of about 6–250 microns, with a preferred aspect ratio of length to diameter of at least 6–200. The particles to be incorporated normally are crystalline, substantially equiaxed particles of about 1 to 10 microns diameter.

Particularly advantageous composite materials may be produced by including whiskers, fibers, or particles coated with a refractory material as the dispersoid in the $TiB_2$ matrix. Suitable coating materials include zirconia, hafnia, yttria, or other refractory oxides with melting or decomposition points higher than 1700° C., alone or as mixtures or solid solutions with other oxides including alumina; or refractory carbides, nitrides, or carbonitrides of titanium, zirconium, hafnium, vanadium, niobium, tantalum, chromium, molybdenum, or tungsten. The coating material is different from the dispersoid material, and is preferably of a thickness between a monolayer and ⅓ the dispersoid diameter. Such coated dispersoids combine the bulk (e.g. mechanical) properties of the core material with the surface (e.g. chemical) properties of the coating.

The useful life and performance of articles in accordance with this invention depends, in large part, on the volume taken up by the dispersed phase in the article. The whiskers, fibers, or particles should comprise about 5-60% by volume of the densified composite. The preferred range of refractory whisker, fiber, or particle content is about 5-50% by volume. A more preferred range is about 5-30% by volume.

Optionally, in addition to the above-described dispersoids, the composite may include one or more other dispersed components. For example, whiskers, fibers, or particles of other materials may be included in an amount of about 5-55% by volume of the densified composite. The preferred other dispersoids are of hard refractory carbide, nitride or carbonitride of titanium, zirconium, hafnium, vanadium, niobium, tantalum, chromium, molybdenum, or tungsten; or zirconia, hafnia, silicon nitride, tungsten diboride, or hafnium diboride, or mixtures or solid solutions of these materials. The total amount of all dispersoids however, should not exceed about 60% and preferably is in the range of 5-40% by volume. The hard refractory dispersoids are uniformly distributed in the titanium diboride matrix.

The material of the invention may further contain additives and impurities in addition to the hereinbefore mentioned titanium diboride and dispersoids. Such further additional materials may be selected to contribute to the desirable final properties of the composite, and are preferably present in an amount less than about 5% by weight based on the total weight of the material. The starting materials should be selected to include only amounts of impurities which will not have a significant negative effect on the desired properties.

The materials described herein have a composite microstructure of refractory whiskers, fibers, and/or particulate refractory grains, uniformly dispersed in a matrix containing titanium diboride grains. For optimizing the desirable properties, particularly the strength of the composite of the present invention, it is preferable to maximize the density of the final densified composites, that is, to densities greater than 98% of theoretical.

Articles formed from the densified composite materials described herein may be coated with one or more adherent layers of hard refractory materials, for example by known chemical vapor deposition or physical vapor deposition techniques. Typical chemical vapor deposition techniques are described in U.S. Pat. Nos. 4,406,667, 4,409,004, 4,416,670, and 4,421,525, all to Sarin et al. The hard refractory materials suitable for coating articles according to the present invention include the carbides, nitrides, and carbonitrides of titanium, zirconium, hafnium, vanadium, niobium, tantalum, chromium, molybdenum, and tungsten, and mixtures and solid solutions thereof, and alumina, zirconia, hafnia, and yttria, and mixtures and solid solutions thereof. Each layer may be the same or different from adjacent or other layers. Such coatings are especially advantageous when applied to cutting tools formed from the densified composites of the present invention.

A process for preparation of the composites described above involves consolidating or densifying, by sintering or hot pressing, the blended materials to densities approaching theoretical density, e.g. at least about 98% of theoretical, while achieving optimum levels of mechanical strength and fracture toughness at both room temperature and elevated temperature, making the composites particularly useful as cutting tools in metal removing applications.

The hard refractory alumina whiskers, fibers, or particles with or without other dispersoids, are thoroughly dispersed in the $TiB_2$ matrix, for example by wet blending in a non-reactive medium, then drying. The mixture is then compacted to a high density by sintering or hot pressing techniques. A composition for the production of abrasion resistant materials according to the present invention may be made by employing $TiB_2$ powder, preferably of average particle size below about 3 microns.

In the initial compositions employed in the fabrication, the hard refractory alumina whiskers, fibers, or particles comprise about 5-60% of the total volume of the densified article, as set out above. Optionally, as described above, other dispersoids may be admixed with the alumina first dispersoids and $TiB_2$, up to about 55% by volume of the dry mixture. The total volume of the dispersoids in the densified composite should be limited to about 60% by volume. In the densified composite, the balance of the composite material normally comprises the matrix of titanium diboride grains, although minor amounts of other materials may be included, as described hereinbefore. The starting materials may be processed to a powder compact of adequate green strength by thoroughly mixing the particulate or powder starting materials by processes such as dry milling or ball milling in a nonreactive liquid medium, such as toluene or methanol; admixing the whisker or fiber dispersoids by high shear wet blending, preferably in a nonreactive liquid medium; and compacting the mixture, for example by pressing, injection molding, extruding, or slip casting. Processing may also optionally include a presintering or prereacting step in which either the uncompacted material or the compact is heated at moderate temperatures.

Since the strength of articles in accordance with this invention decreases with increasing porosity in the total compact, it is important that the compact be sintered or hot pressed to a density as nearly approaching 100% of theoretical density as possible, preferably at least about 98% of theoretical density. The measure of percent of theoretical density is obtained by a weighted average of the densities of the components of the compact, and is preferably at least about 2.5 $MN/m^{3/2}$.

The following Examples are presented to enable those skilled in the art to more clearly understand and practice the present invention. These Examples should not be considered as a limitation upon the scope of the present invention but merely as being illustrative and representative thereof.

EXAMPLES

Titanium diboride-based composite bodies were made from a starting formulation of titanium diboride powder mixed with alumina particles or whiskers, as shown in the Table. In each case, the dispersoids were wet blended in a high shear blender in methanol with the matrix powder. The alumina/$TiB_2$ mixtures from each batch were dried at about 75° C., and pressed at about 1750° C.-1900° C. and about 5000 psi for lengths of time sufficient to obtain composite bodies of near theoretical density, about 0.5-3.0 hr. The average density as percent of theoretical (%T.D.), hardness (Hd, $GN/m^2$), and fracture toughness (IFT, $MN/m^{3/2}$) of the composite bodies for each formulation are shown in the Table. Relative fracture toughness values were obtained by an indentation fracture test utilizing a Vickers diamond pyramid indenter.

TABLE

| | Dispersoids | | | | Hd, | IFT, |
|---|---|---|---|---|---|---|
| Ex. # | v/o | Matl. | Form | % TD | $GN/m^2$ | $MN/m^{3/2}$ |
| 1 | 25 | $Al_2O_3$ | P | 99.5 | 17.9 ± 0.1 | 3.0 ± 0.1 |
| 2 | 20 | $Al_2O_3$ | W | 99.4 | 17.8 ± 0.9 | 4.3 ± 0.3 |
| 3 | 0 | — | — | 100 | 19.0 ± 0.5 | 1.5 ± 0.3 |

P = particles; W = whiskers; v/o = volume %

The materials and articles according to the invention can be prepared by hot pressing techniques, e.g. as described above, or by hot isostatic pressing and sintering techniques, e.g. a technique in which pressed green compacts containing titanium diboride and whiskers, fibers, or particles are sintered to a dense, polycrystalline product. The materials may be combined before hot pressing or sintering by the method described in the Examples, or by other methods known in the art.

Densified ceramic articles made in accordance with this invention are hard, tough, nonporous, abrasion resistant, and resistant to oxidation. Applications of these articles include, but are not limited to, cutting tools, mining tools, stamping and deep-drawing tools, extrusion dies, wire and tube drawing dies, nozzles, guides, bearings, wear-resistant and structural parts, and ceramic armor, and will be especially useful as shaped cutting tools for continuous or interrupted milling, turning, or boring of steel stock. Such machining operations may be carried out in conventional equipment operated at a speed of about 100-1500 sfm, and at a feed rate of about 0.005-0.03 in/rev.

While there has been shown and described what are at present considered the preferred embodiments of the invention, it will be obvious to those skilled in the art that various changes and modifications can be made therein without departing from the scope of the invention as defined by the appended claims.

We claim:

1. A densified, hard, abrasion resistant ceramic-based composite article of improved fracture toughness comprising about 5-60 volume percent of one or more first dispersoids selected from the group consisting of alumina whiskers, chopped alumina fibers, and alumina particles uniformly distributed in a matrix of titanium diboride.

2. An article according to claim 1 wherein the dispersoid is present in an amount of about 5-50 volume percent.

3. An article according to claim 2 wherein the dispersoid aspect ratio of length to diameter is about 6-200.

4. A cutting tool comprising an article according to claim 3 wherein the dispersoid aspect ratio is about 15-100.

5. A wear part comprising an article according to claim 3 wherein the dispersoid aspect ratio is about 100-200.

6. An article according to claim 1 having a density of at least about 98% of theoretical density.

7. An article according to claim 1 having a fracture toughness of at least about 2.5 $MN/m^{3/2}$.

8. An article according to claim 1 further comprising about 5-55 volume percent of one or more other dispersoids selected from the group consisting of whiskers, fibers, and particles of hard refractory carbides, nitrides, and carbonitrides of titanium, zirconium, hafnium, vanadium, niobium, tantalum, chromium, molybdenum, and tungsten, and hafnium diboride, tungsten diboride, silicon nitride, alumina, zirconia, and hafnia, and mixtures and solid solutions thereof, the combined percent of all dispersoids not exceeding about 60 volume percent.

9. A coated article comprising an article according to claim 1 having deposited thereon a hard, wear resistant coating of one or more layers independently selected from the group consisting of the refractory carbides, nitrides, and carbonitrides of titanium, zirconium, hafnium, vanadium, niobium, tantalum, chromium, molybdenum, and tungsten, and mixtures and solid solutions thereof, and alumina, zirconia, yttria and hafnia, and mixtures and solid solutions thereof.

10. A coated article according to claim 9 wherein each layer is about 0.1-20 microns thick, and the total coating thickness does not exceed 20 microns.

11. An article according to claim 1 wherein the first dispersoids include whiskers, fibers, or particles coated with a refractory material different from the first dispersoid material, the coating thickness being between a monolayer and about ⅓ the diameter of the whiskers, fibers, or particles.

12. An article according to claim 11 wherein the coating comprises at least one of the refractory carbides, nitrides, or carbonitrides of titanium, zirconium, hafnium, vanadium, niobium, tantalum, chromium, molybdenum, or tungsten.

13. An article according to claim 11 wherein the coating comprises at least one of zirconia, hafnia, or yttria.

14. A densified, hard, abrasion resistant ceramic-based composite article of improved fracture toughness comprising about 5-60 volume percent of one or more first dispersoids selected from the group consisting of alumina whiskers, chopped alumina fibers, and alumina particles uniformly distributed in a matrix of titanium diboride; and prepared by a process comprising the steps of wet blending in a non-reactive liquid medium a mixture comprising about 95-40 volume percent titanium diboride powder and about 5-60 volume percent of one or more first dispersoids selected from the group consisting of alumina whiskers, chopped alumina fibers, and alumina particles to uniformly disperse the first dispersoids in the powder and liquid medium;

drying the mixture to remove the liquid medium; and consolidating the dry mixture to a density of at least about 98% of theoretical density to form the article.

15. A process for preparing a densified, hard, abrasion resistant ceramic-based composite article of improved fracture toughness comprising the steps of:

wet blending in a non-reactive liquid medium a mixture comprising about 95-40 volume percent titanium diboride powder and about 5-60 volume percent of one or more first dispersoids selected from the group consisting of alumina whiskers, chopped alumina fibers, and alumina particles to uniformly disperse the first dispersoids in the powder and liquid medium;

drying the mixture to remove the liquid medium; and consolidating the dry mixture to a density of at least about 98% of theoretical density to form the article.

16. A process according to claim 15 in which the wet blending step comprises wet blending in a non-reactive medium the mixture further comprising about 5–55 volume percent of other dispersoids selected from the group consisting of whiskers, fibers, and particles of hard refractory carbides, nitrides, and carbonitrides of titanium, zirconium, hafnium, vanadium, niobium, tantalum, chromium, molybdenum, and tungsten, and hafnium diboride, tungsten diboride, silicon nitride, zirconia, and hafnia, alumina, the combined percent of all dispersoids not exceeding about 60 volume percent.

17. A process according to claim 15 further comprising the step of depositing on the densified article a hard, wear resistant coating of one or more layers independently selected from the group consisting of the refractory carbides, nitrides, and carbonitrides of titanium, zirconium, hafnium, vanadium, niobium, tantalum, chromium, molybdenum, and tungsten, and mixtures and solid solutions thereof, and alumina, zirconia, hafnia, and yttria and mixtures and solid solutions thereof.

18. A process according to claim 15 wherein the consolidating step comprises pressing the dry mixture at about 5000 psi and about 1750°–1900° C. for about 0.5–3.0 hr.

19. A process according to claim 15 wherein the first dispersoids include whiskers, fibers, or particles coated with a refractory material different from the first dispersoid material, the coating thickness being between a monolayer and about ⅓ the diameter of the whiskers, fibers, or particles.

20. A process according to claim 19 wherein the coating comprises at least one of the refractory carbides, nitrides, or carbonitrides of titanium, zirconium, hafnium, vanadium, niobium, tantalum, chromium, molybdenum, or tungsten.

21. A process according to claim 19 wherein the coating comprises at least one of zirconia, hafnia, or yttria.

22. A process according to claim 15 further comprising the step before the wet blending step of coating one or more of the first dispersoids with a refractory material different from the first dispersoid material, the coating thickness being between a monolayer and about ⅓ the diameter of the first dispersoid.

23. A method for continuous or interrupted machining of steel stock comprising the step of milling, turning, or boring the stock with a shaped, densified, hard, abrasion resistant ceramic-based composite cutting tool of improved fracture toughness comprising about 5–60 volume percent of one or more dispersoids selected from the group consisting of alumina whiskers, chopped alumina fibers, and alumina particles, uniformly distributed in a matrix of titanium diboride; wherein the machining speed is about 100–1500 sfm and the feed rate is about 0.005–0.03 in/rev.

* * * * *